US008157518B2

(12) United States Patent
Decker et al.

(10) Patent No.: US 8,157,518 B2
(45) Date of Patent: Apr. 17, 2012

(54) LOW CAMBER MICROFAN

(75) Inventors: John Decker, Cypress, TX (US); Chellappa Balan, Niskayuna, NY (US)

(73) Assignee: Xcelaero Corporation, San Luis Obispo, CA (US)

( * ) Notice: Subject to any disclaimer, the term of this patent is extended or adjusted under 35 U.S.C. 154(b) by 926 days.

(21) Appl. No.: 12/074,328

(22) Filed: Mar. 3, 2008

(65) Prior Publication Data

US 2008/0219849 A1 Sep. 11, 2008

Related U.S. Application Data

(60) Provisional application No. 60/905,153, filed on Mar. 5, 2007.

(51) Int. Cl.
*F03D 11/00* (2006.01)
*F03B 3/04* (2006.01)
*F01D 5/14* (2006.01)

(52) U.S. Cl. ..... 415/211.2; 415/220; 416/223 A; 416/223 R; 416/DIG. 2; 416/DIG. 5

(58) Field of Classification Search ..... 415/220; 416/197 A, 203, 223 A, 223 R, 237, 242, 416/243, DIG. 2, DIG. 5
See application file for complete search history.

(56) References Cited

U.S. PATENT DOCUMENTS

| | | | | |
|---|---|---|---|---|
| 4,981,414 | A | 1/1991 | Sheets | |
| 5,088,892 | A * | 2/1992 | Weingold et al. | 415/193 |
| 5,152,661 | A | 10/1992 | Sheets | |
| 5,577,888 | A * | 11/1996 | Capdevila et al. | 415/210.1 |
| 6,116,856 | A | 9/2000 | Karadgy et al. | |
| 6,129,528 | A | 10/2000 | Bradbury et al. | |
| 6,386,830 | B1 | 5/2002 | Slipper et al. | |
| 6,508,630 | B2 * | 1/2003 | Liu et al. | 416/228 |
| 6,709,239 | B2 | 3/2004 | Chandraker | |
| 6,722,849 | B1 | 4/2004 | Lievens et al. | |
| 6,755,615 | B2 | 6/2004 | Chapman | |
| 7,168,918 | B2 | 1/2007 | Balan et al. | |
| 7,175,393 | B2 | 2/2007 | Chandraker | |
| 7,374,403 | B2 * | 5/2008 | Decker et al. | 416/223 R |
| 2003/0012645 | A1 | 1/2003 | Donnaruma et al. | |
| 2005/0089403 | A1 | 4/2005 | Ito et al. | |
| 2005/0184605 | A1 | 8/2005 | Vinson et al. | |
| 2005/0186096 | A1 * | 8/2005 | Vinson et al. | 417/423.1 |
| 2007/0036647 | A1 | 2/2007 | Abdelwahab et al. | |
| 2008/0131272 | A1 | 6/2008 | Wood et al. | |
| 2008/0148564 | A1 | 6/2008 | Burton et al. | |
| 2009/0317227 | A1 | 12/2009 | Grover et al. | |

FOREIGN PATENT DOCUMENTS

| | | |
|---|---|---|
| WO | WO 90/09525 | 8/1990 |

* cited by examiner

*Primary Examiner* — Edward Look
*Assistant Examiner* — Jason Davis
(74) *Attorney, Agent, or Firm* — Henry C. Query, Jr.

(57) ABSTRACT

A cooling fan comprises an impeller which includes a plurality of radially extending blades, each of which includes a blade hub, a blade tip and a blade midspan approximately midway between the hub and the tip. In addition, each blade comprises a blade suction surface, and substantially the entire blade suction surface is visible from the forward looking aft direction.

33 Claims, 11 Drawing Sheets

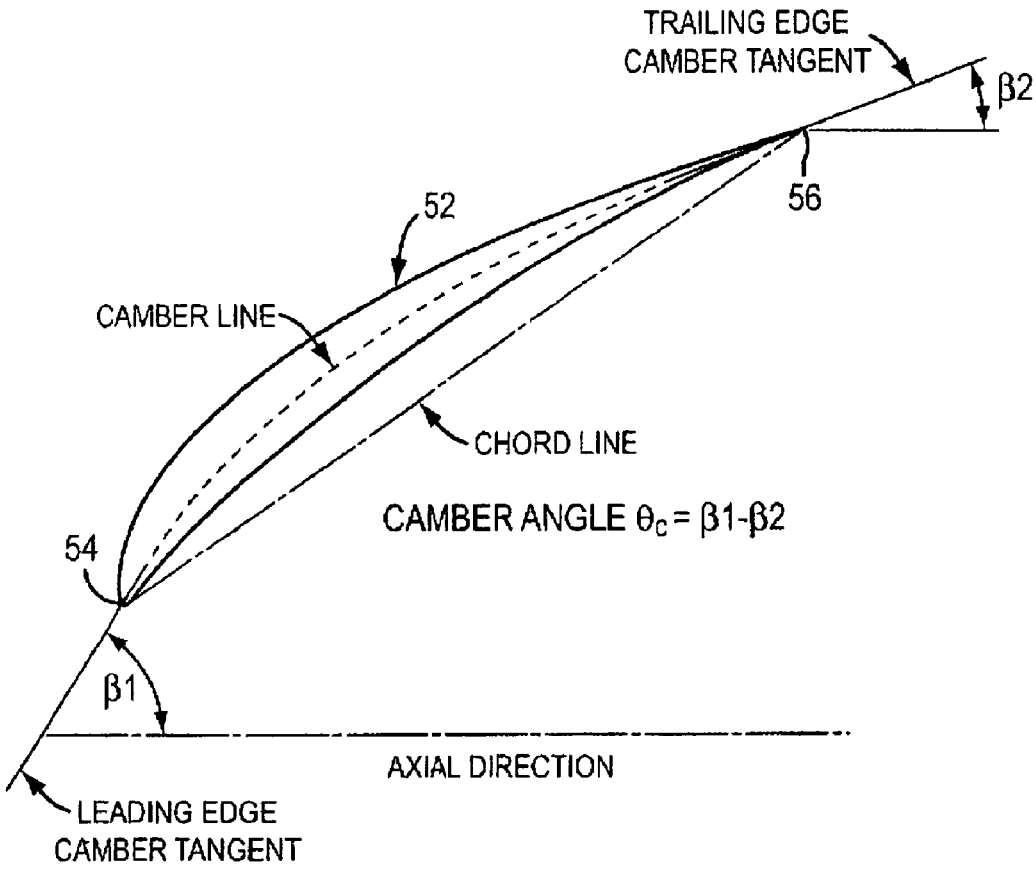
FIG. 10
(PRIOR ART)
FIG. 11
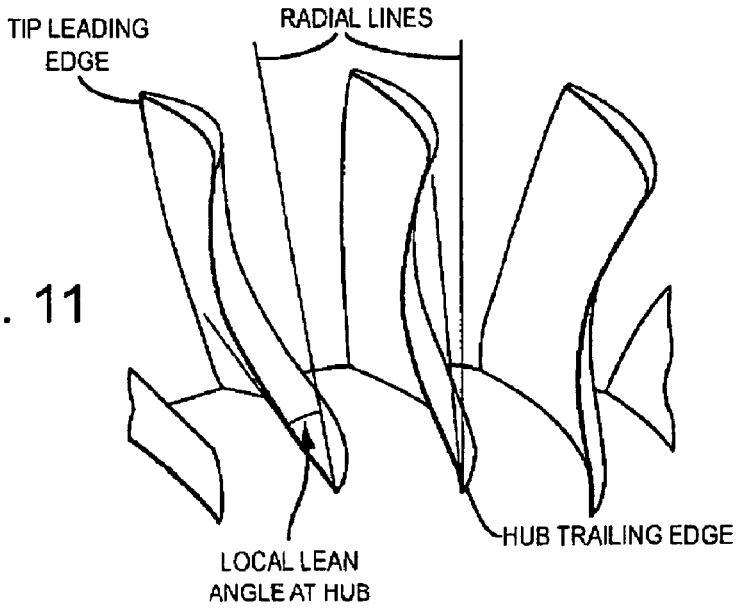

LOW CAMBER MICROFAN

This application is based on and claims the benefit of U.S. Provisional Patent Application No. 60/905,153, which was filed on Mar. 5, 2007.

BACKGROUND OF THE INVENTION

The present invention relates to a high efficiency, high work coefficient fan which can be used, for example, in electronics cooling applications. More particularly, the present invention relates to such a fan which comprises an impeller and an outlet guide vane assembly that can each be manufactured using an injection molding, casting or similar technique.

Many prior art cooling fans include a motor-driven impeller which propels a stream of air through a fan housing. These fans may also comprise an outlet guide vane assembly positioned downstream of the impeller to both de-swirl and increase the static pressure of the air. The impeller and the outlet guide vane assembly each include a plurality of radially extending blades or vanes. The shape of each blade or vane can be defined by the values of camber, chord and stagger for each of a plurality of radially spaced airfoil segments in the blade or vane and the degrees of lean and bow for each of the leading and trailing edges of the blade or vane. In addition, the overall configuration of the impeller and the outlet guide vane assembly can be defined in terms of the solidity and aspect ratio of the blades or vanes as a whole.

In designing an impeller or an outlet guide vane assembly for a particular cooling fan, the blades and vanes are usually configured to enable the fan to meet pre-determined performance criteria. However, this can result in the blades or vanes having relatively complex three-dimensional shapes which are difficult to manufacture. In particular, a problem with some prior art cooling fans is the inability of the impeller and the outlet guide vane assembly to be manufactured using an injection molding technique, which is a preferred method for achieving high part yields at low cost.

Referring to FIGS. 3A and 3B, for example, which depict a prior art impeller blade from the forward looking aft and the aft looking forward positions, respectively, one can see that the high degree of trailing edge camber near the hub results in a portion of the suction surface not being visible from the forward looking aft position. This condition would prevent the impeller from being manufactured using an injection molding process. Also, the overlapping impeller blades of the prior art impeller illustrated in FIG. 5 would prevent the impeller from being manufactured using this same technique. Thus, in order to be able to manufacture an impeller using an injection molding technique, the impeller blades must not overlap and the entire suction surface of each impeller blade must be visible from the forward looking aft position.

Referring to FIGS. 8A and 8B, which depict a prior art outlet guide vane from the forward looking aft and the aft looking forward positions, respectively, the high degree of trailing edge camber along the span of the vane prevents the entire suction surface from being seen from the forward looking aft position. Consequently, the outlet guide vane assembly could not be manufactured using an injection molding process. Thus, in order to be able to manufacture an outlet guide vane assembly using an injection molding process, the entire suction surface of each guide vane must be visible from the forward looking aft position. In addition, the flowpath between the leading and trailing edges of the guide vane must have a constant radius.

SUMMARY OF THE INVENTION

In accordance with one embodiment of the present invention, a cooling fan comprises an impeller which includes a plurality of radially extending blades, each of which includes a blade hub, a blade tip and a blade midspan approximately midway between the hub and the tip. In addition, each blade comprises a blade suction surface, and substantially the entire blade suction surface is visible from the forward looking aft direction. In addition, the impeller may be designed so that no two adjacent blades overlap when viewed in the forward looking aft direction.

In accordance with another embodiment of the invention, each blade may comprise a camber of between about 52° and 62° at the blade hub, between about 45° and 56° at the blade midspan and between about 28° and 38° at the blade tip. In addition, each blade may comprise a stagger of between about 19° and 29° at the blade hub, between about 36° and 46° at the blade midspan and between about 47° and 57° at the blade tip. Furthermore, each blade may comprise a solidity of between about 1.6 and 2.0 at the blade hub, between about 1.15 and 1.55 at the blade midspan and between about 0.85 and 1.25 at the blade tip, and a normalized chord of about 1.0 at the blade hub, between about 0.95 and 1.1 at the blade midspan and between about 0.85 and 1.25 at the blade tip.

In accordance with yet another embodiment of the invention, the cooling fan comprises an outlet guide vane assembly which includes a plurality of radially extending guide vanes, each of which comprises a vane hub, a vane tip and a vane midspan approximately midway between the vane hub and the vane tip. In addition, each blade comprises a vane suction surface, and substantially the entire vane suction surface is visible from the forward looking aft direction.

In accordance with a further embodiment of the invention, each guide vane may comprise a camber of between about 38° and 48° at the vane hub, between about 32° and 42° at the vane midspan and between about 36° and 46° at the vane tip. In addition, each guide vane may comprise a stagger of between about 16° and 26° at the vane hub, between about 11° and 21° at the vane midspan and between about 13° and 23° at the vane tip. Furthermore, each guide vane may comprise a solidity of between about 1.2 and 2.2 at the vane hub, between about 1.0 and 2.0 at the vane midspan and between about 0.8 and 1.8 at the vane tip, and a normalized chord of about 1.0 at the vane hub, between about 0.95 and 1.05 at the vane midspan and between about 0.95 and 1.05 at the blade tip.

Thus, the cooling fan of the present invention ideally comprises an impeller which can be manufactured using an injection molding, casting or a similar technique. Furthermore, the cooling fan may comprise an outlet guide vane assembly which can likewise be manufactured using an injection molding, casting or a similar technique.

These and other objects and advantages of the present invention will be made apparent from the following detailed description, with reference to the accompanying drawings. In the drawings, the same reference numbers are used to denote similar components in the various embodiments.

BRIEF DESCRIPTION OF THE DRAWINGS

FIG. 10 is a representation of an exemplary airfoil segment illustrating several identifying features of the segment;

FIG. 11 is an aft-looking-forward view of a number of the guide vanes of an exemplary embodiment of an outlet guide vane assembly of the present invention which illustrates several identifying features of the guide vanes;

DETAILED DESCRIPTION OF THE INVENTION

The present invention is applicable to a variety of air movers. However, for purposes of brevity it will be described in the context of an exemplary vane-axial cooling fan. Nevertheless, the person of ordinary skill in the art will readily appreciate how the teachings of the present invention can be applied to other types of air movers. Therefore, the following description should not be construed to limit the scope of the present invention in any manner.

Figure 1:
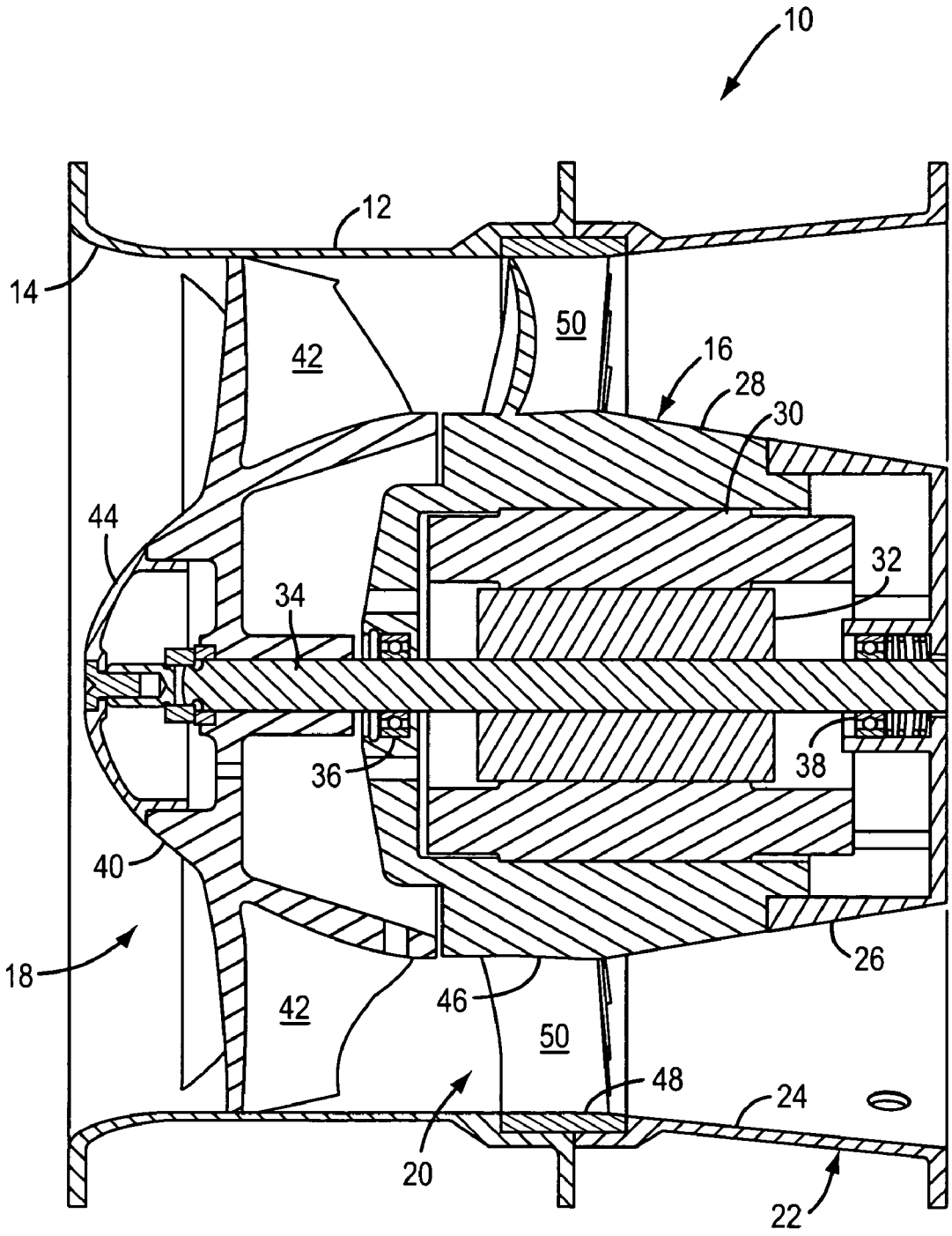
FIG. 1 is a cross sectional view of an exemplary vane axial cooling fan.

Referring to FIG. 1, an exemplary vane axial cooling fan 10 is shown to comprise a fan housing 12 which includes a converging inlet 14, a motor 16 which is supported in the fan housing, an impeller 18 which is driven by the motor, and an outlet guide vane assembly 20 which extends radially between the motor and the fan housing. The cooling fan 10 may also include a diffuser section 22 which is located downstream of the outlet guide vane assembly and which includes a diffuser tube 24 that is connected to or formed integrally with the fan housing 12 and a tail cone 26 that is connected to or formed integrally with the downstream end of the motor 16.

The motor 16 includes a motor housing 28, a stator 30 which is mounted within the motor housing, a rotor 32 which is positioned within the stator, and a rotor shaft 34 which is connected to the stator. The rotor shaft 34 is rotationally supported in a front bearing 36 which is mounted in the motor housing 28 and a rear bearing 38 which is mounted in the tail cone 26.

The impeller 18 comprises an impeller hub 40 which is connected to the rotor shaft 34 by suitable means and a number of impeller blades 42 which extend radially outwardly from the impeller hub. The impeller hub 40 is sloped so that the annular area around the upstream end of the impeller 18 is larger than the annular area around the downstream end of the impeller. As is known in the art, this configuration reduces the static pressure rise of the air across the impeller 18. The impeller hub 40 may also include a removable nose cone 44 to facilitate mounting the impeller 18 to the rotor shaft 34.

Referring still to FIG. 1, the outlet guide vane assembly 20 includes a hub 46 which is attached to or formed integrally with the motor housing 28, an outer ring 48 which is secured to the fan housing 12 by suitable means, and a plurality of guide vanes 50 which extend radially between the hub and the outer ring.

In operation of the cooling fan 10, the motor 16 spins the impeller 18 to draw air into and through the fan housing 12. The converging inlet 14 delivers a uniform, axial air stream to the impeller 18 and contracts the air stream slightly to mitigate the performance and noise penalties normally associated with inlet flow distortion. As the air stream flows through the impeller 18, the sloping impeller hub 40 reduces the static pressure rise of the air stream. The guide vanes 50 then receive the swirling air stream from the impeller 18 and turn the air stream in substantially the axial direction. In the process of deswirling the air stream, the static pressure of the air increases. The diffuser section 22 receives the air stream from the outlet guide vane assembly 20 and decelerates it to further increase the static pressure of the air.

Figure 2:
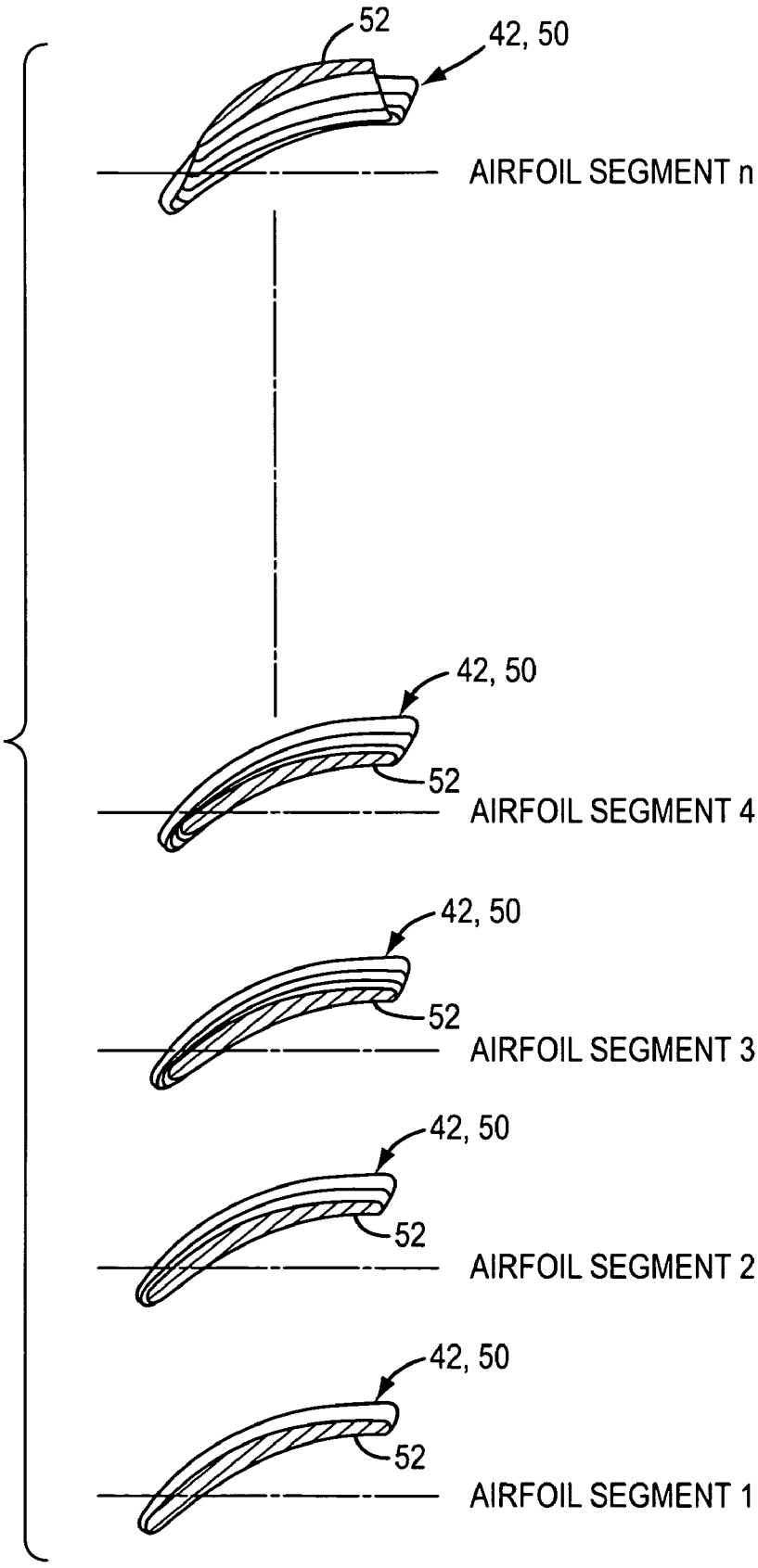
FIG. 2 is a representation of a succession of radially spaced airfoil segments of an exemplary impeller blade or outlet guide vane, with Airfoil Segment 1 being closest to the hub of the blade or vane and Airfoil Segment n being closest to the tip of the blade or vane.
Figure 3A:
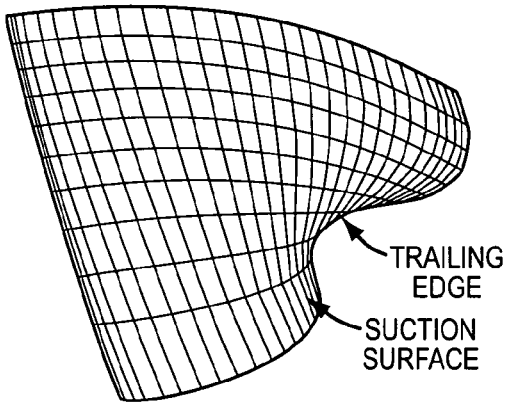
FIG. 3A (PRIOR ART)
FIG. 3A is a front-looking-aft view of a prior art impeller blade.
Figure 3B:
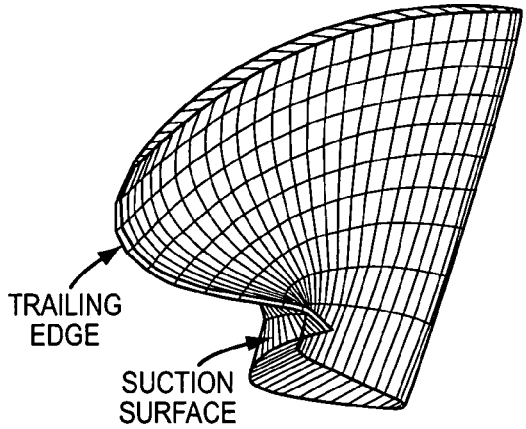
FIG. 3B (PRIOR ART)
FIG. 3B is an aft-looking-forward view of the prior art impeller blade of FIG. 3A.

Each of the impeller blades 42 and the outlet guide vanes 50 may be considered to comprise a radial stack of a number of individual airfoil segments. As shown in FIG. 2, each airfoil segment 52 represents a cross section of the impeller blade 42 or the guide vane 50 at a specific radial distance from its hub. The number of airfoil segments 52 which each impeller blade 42 and guide vane 50 is designed to have is dependent in part on the required configuration of these components. In one embodiment of the present invention, each of the impeller blades 42 is designed to comprise nine airfoil segments 52 and each of the guide vanes 50 is designed to comprise ten airfoil segments 52.

Referring to FIG. 10, an exemplary airfoil segment 52 comprises a leading edge 54 and a trailing edge 56, with the airfoil segment being oriented such that the air stream meets the airfoil segment at the leading edge and departs the airfoil segment at the trailing edge. An airfoil segment may be defined in terms of its camber angle, chord and stagger angle. The camber line is the curve extending from the leading edge 54 to the trailing edge 56 through the middle of the airfoil segment 52. The camber angle $\theta_c$ is the difference between the leading edge camber angle $\beta_1$ (i.e., the angle of the camber line at the leading edge 54, relative to the axial direction) and the trailing edge camber angle $\beta_2$ (i.e., the angle of the camber line at the trailing edge 56, relative to the axial direction). The chord is the straight line distance between the leading and trailing edges 54, 56 of the airfoil segment 52. The angle that this chord line makes relative to the axial direction defines the stagger angle.

Other terms used to characterize the shape of an impeller and an outlet guide vane assembly are solidity and aspect ratio. Solidity is defined as the ratio of the chord of an airfoil segment to the spacing between that segment and a tangentially adjacent airfoil segment. Aspect ratio is defined as the ratio of the average height of the blade or vein to the average chord of the blade or vane.

In accordance with the present invention, the impeller 18 and the outlet guide vane assembly 20 are designed to enable these components to be produced using an injection molding, casting or similar technique. Moreover, this objective is ideally achieved without reducing the performance of the cooling fan 10. One measure of the performance of a fan is Work Coefficient, which is defined by the following formula:

$$\text{Work Coefficient}=(2\times\Delta H)/u^2, \quad (1)$$

where ΔH is the total enthalpy rise and u is the impeller inlet pitch line wheel speed. In accordance with the present invention, the Work Coefficient for the cooling fan 10 is optimally above about 1.4.

Figure 4A:
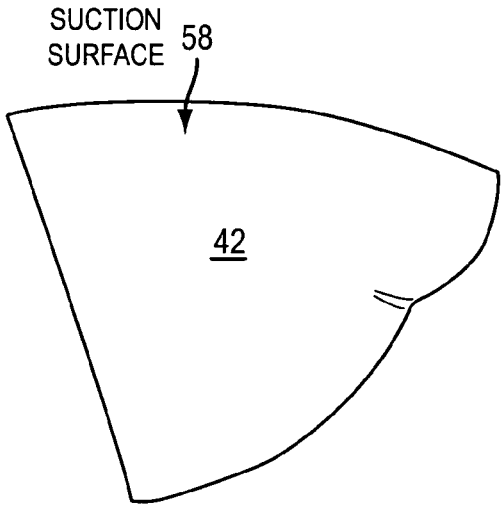
FIG. 4A is a front-looking-aft view of an exemplary impeller blade of the present invention.
Figure 4B:
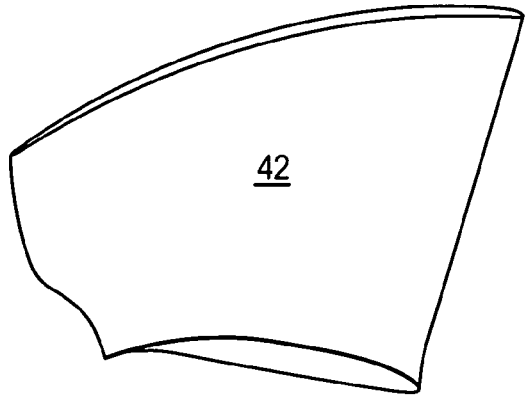
FIG. 4B is an aft-looking-forward view of the impeller blade of FIG. 4A.
Figure 5:
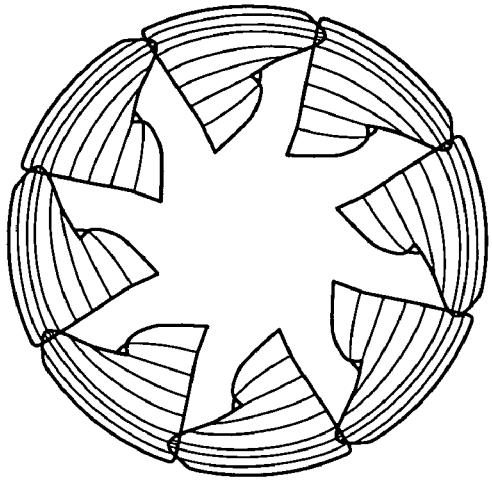
FIG. 5 (PRIOR ART)
FIG. 5 is a front view of a prior art impeller, with the impeller hub being omitted for purposes of clarity.

Thus, the impeller blades 42 are designed to enable the impeller 18 to be manufactured using an injection molding, casting or similar technique. As shown in FIGS. 4A and 4B, each impeller blade 42 comprises a suction surface 58 which is entirely visible from a forward looking aft position. This is accomplished by restricting the amount of camber of the impeller blade near its hub.

Figure 6:
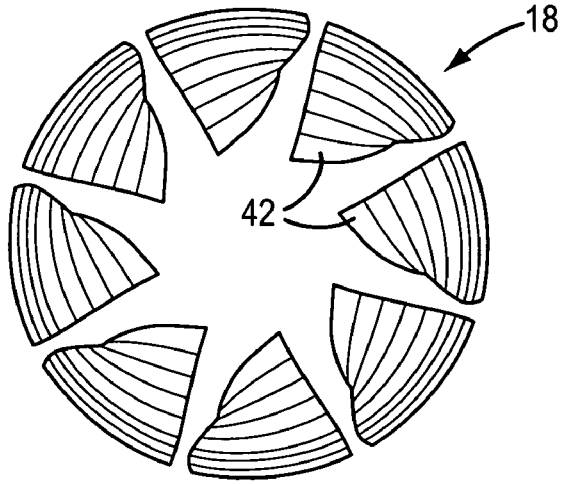
FIG. 6 is a front view of one embodiment of an impeller of the present invention, with the impeller hub being omitted for purposes of clarity.
Figure 7:
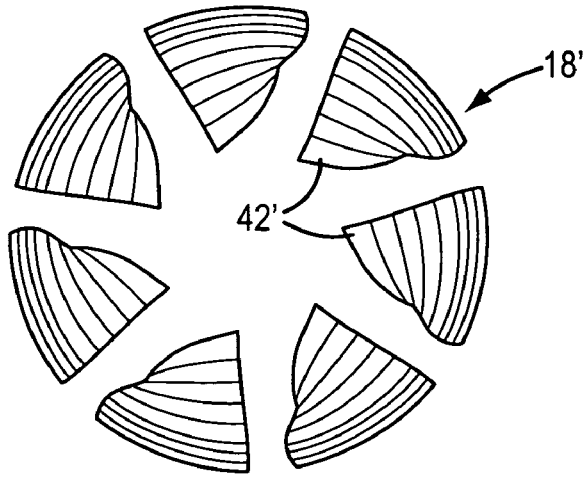
FIG. 7 is a front view of a second embodiment of an impeller of the present invention, with the impeller hub being omitted for purposes of clarity.
Figure 8A:
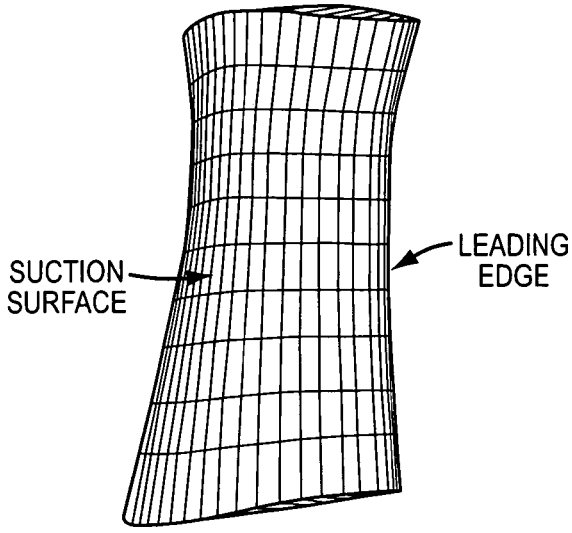
FIG. 8A (PRIOR ART)
FIG. 8A is a front-looking-aft view of a prior art outlet guide vane.
Figure 8B:
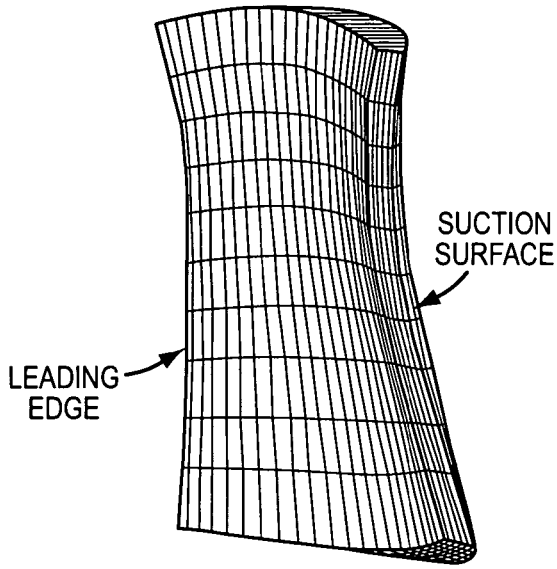
FIG. 8B (PRIOR ART)
FIG. 8B is an aft-looking-forward view of the prior art outlet guide vane of FIG. 8A.

In addition, the impeller 18 is configured so that the impeller blades 42 do not overlap. As shown in FIG. 6, an embodiment of an impeller 18 comprising eight impeller blades 42 is shown in which a minimum gap of approximately 0.05" exists between the blades. In this embodiment, overlap of the blades 42 is avoided by designing the blades to have locally reduced chord and increased camber. Furthermore, overlap can be avoided by designing the impeller 18 with fewer blades 42. FIG. 7, for example, depicts an embodiment of such an impeller 18' which comprises seven impeller blades 42'.

In accordance with the present invention, each impeller blade 42 also comprises the representative values of camber, stagger, solidity and normalized chord provided in Table 1.

TABLE 1

Impeller Blade Geometry

| | Hub | Midspan | Tip |
|---|---|---|---|
| Camber (degrees) | 52-62, preferably 54-59 | 46-56, preferably 49-54 | 28-38, preferably 31-36 |
| Stagger (degrees) | 19-29, preferably 22-27 | 36-46, preferably 39-44 | 47-57, preferably 50-55 |
| Solidity | 1.6-2.0, preferably 1.7-1.95 | 1.15-1.55, preferably 1.25-1.45 | 0.85-1.25, preferably 0.95-1.15 |
| Normalized Chord (chord/chord@hub) | 1.0 | 0.95-1.1, preferably 0.95-1.0 | 0.95-1.2, preferably 0.95-1.05 |

Figure 13A:
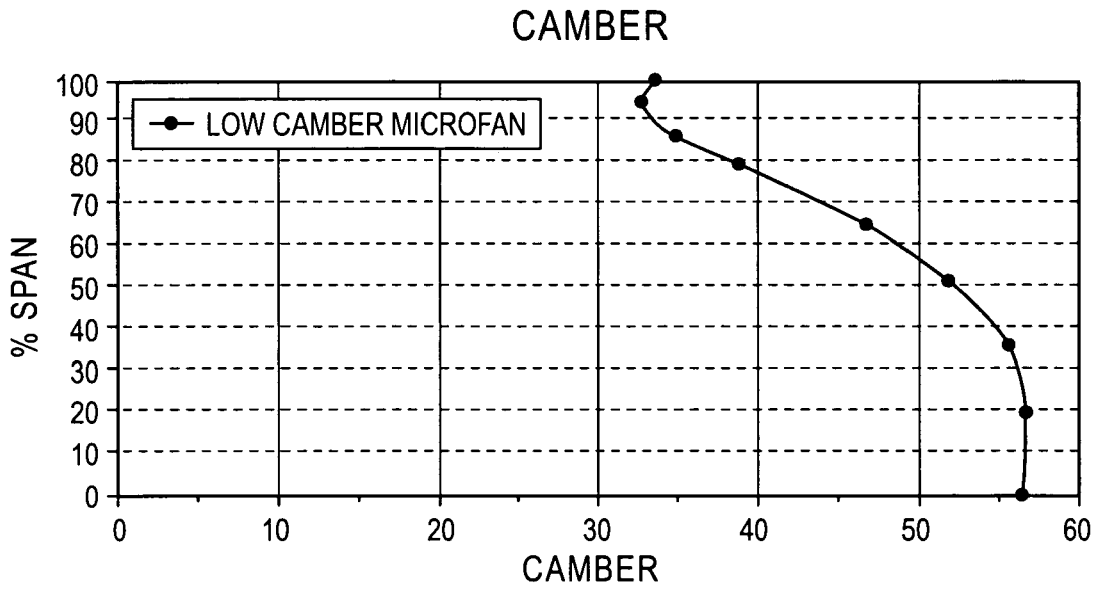
FIGS. 13A through 13D are graphs showing the values of camber, stagger, solidity and normalized chord, respectively, for an embodiment of an impeller blade in accordance with the present invention.
Figure 13B:
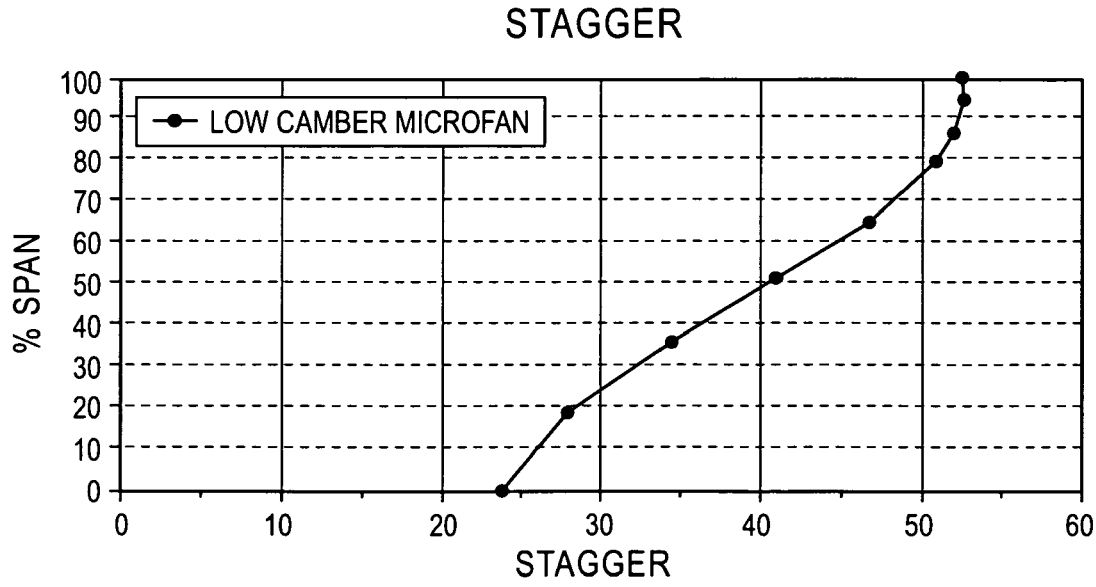
Figure 13C:
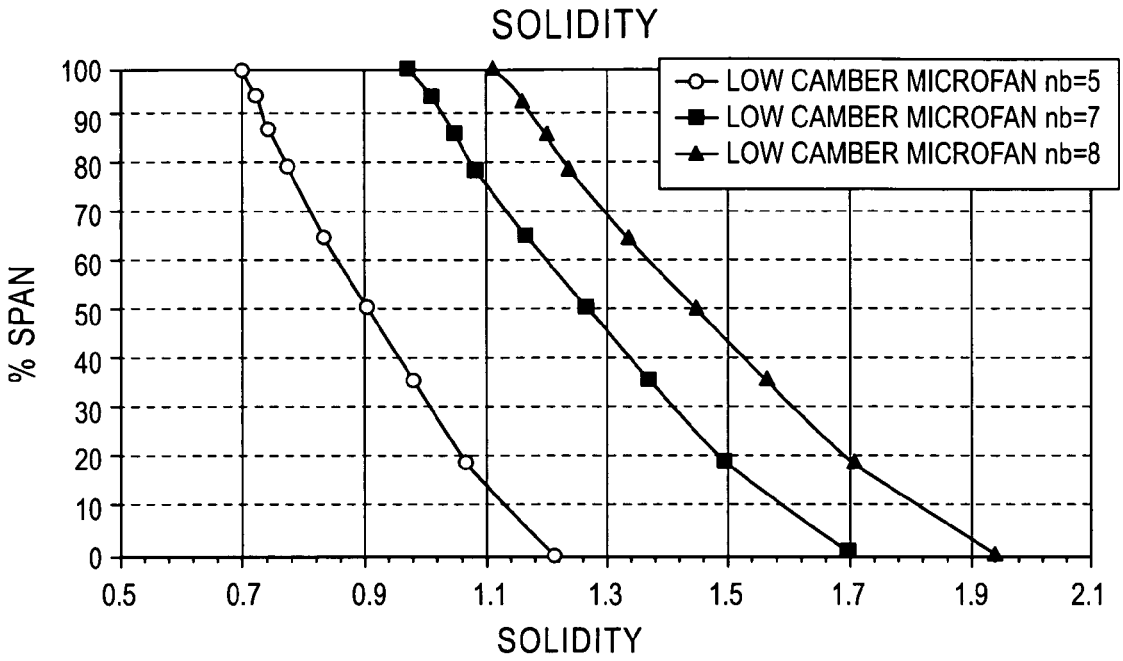
Figure 13D:
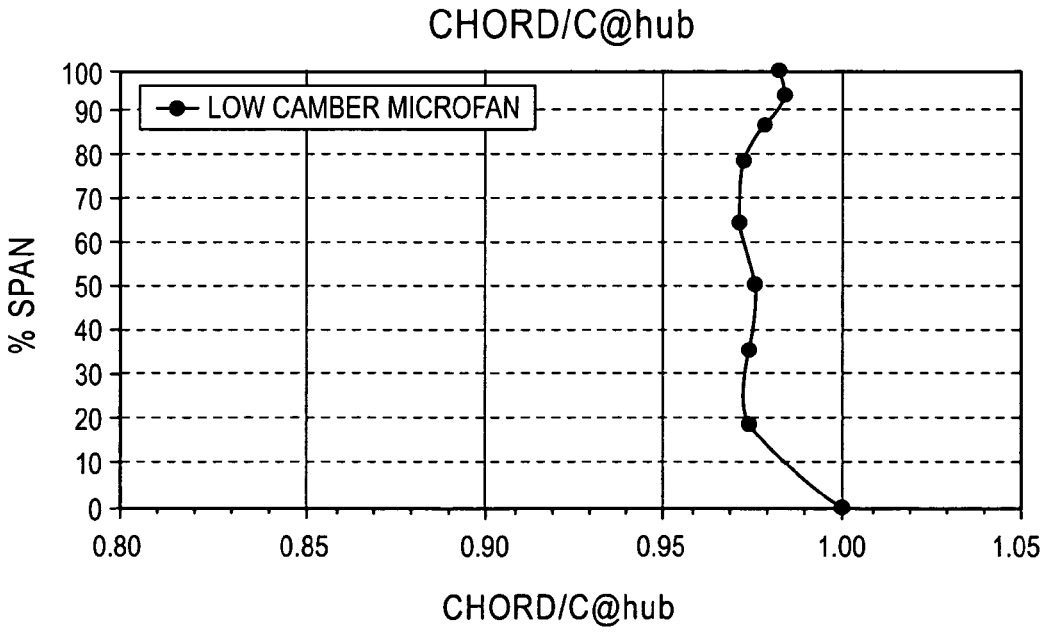

In an exemplary embodiment of the invention in which the impeller 18 comprises eight impeller blades 42, each blade comprises the values of camber, stagger, solidity and normalized chord shown in FIGS. 13A through 13D, respectively. As shown in FIG. 13A, the impeller blades 42 of this embodiment comprise a relatively large degree camber. In addition, the camber of each impeller blades 42 is nearly constant over the radially inner 30% of its span. As shown in FIG. 13B, the stagger angle is lowest at the hub of the impeller blade 42 and increases to a maximum at or near the tip. As shown in FIG. 13C, the solidity of the impeller 18 is maximum at the hub of the impeller blades 42 and decreases to a minimum at the tip of the blades. For purposes of comparison, FIG. 13C also shows the solidity values for impeller embodiments comprising five and seven impeller blades. Also, as shown in FIG. 13D, the chord of each impeller blade 42 is essentially constant across its entire span. In this embodiment, the aspect ratio of the impeller blades 42 is about 0.47.

Figure 9A:
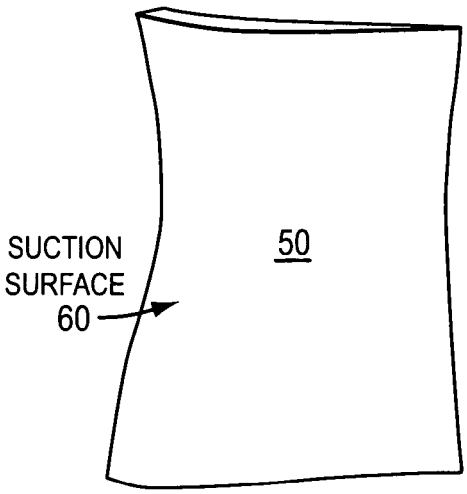
FIG. 9A is a front-looking-aft view of an exemplary outlet guide vane of the present invention.
Figure 9B:
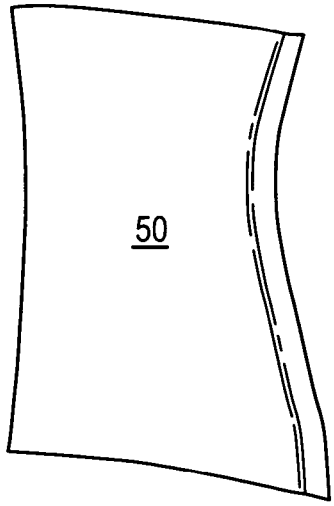
FIG. 9B is an aft-looking-forward view of the outlet guide vane of FIG. 9A.

In accordance with another aspect of the present invention, the outlet guide vanes 50 are also designed to enable the outlet guide vane assembly 20 to be manufactured using an injection molding, casting or similar technique. As shown in FIGS. 9A and 9B, therefore, each guide vane 50 comprises a suction surface 60 which is entirely visible from a forward looking aft position. This is achieved by designing each guide vane 50 with moderate trailing edge camber ($\beta_2$). In addition, the guide vane 50 is designed so that the radius of the flowpath between the leading edge and trailing edges is basically constant.

In accordance with the present invention, each guide vane also comprises the representative values of camber, stagger, solidity and normalized chord provided in Table 2, respectively.

TABLE 2

Guide Vane Geometry

| | Hub | Midspan | Tip |
|---|---|---|---|
| Camber (degrees) | 38-48, preferably 40-45 | 32-42, preferably 35-40 | 36-46, preferably 38-43 |
| Stagger (degrees) | 16-26, preferably 18-23 | 11-21, preferably 13-18 | 13-23, preferably 15-20 |
| Solidity | 1.2-2.2, preferably 1.5-2.0 | 1.0-2.0, preferably 1.2-1.6 | 0.8-1.8, preferably 1.0-1.4 |
| Normalized Chord (chord/chord@hub) | 1.0 | 0.95-1.05, preferably 0.96-1.01 | 0.95-1.05, preferably 0.98-1.03 |

Figure 14A:
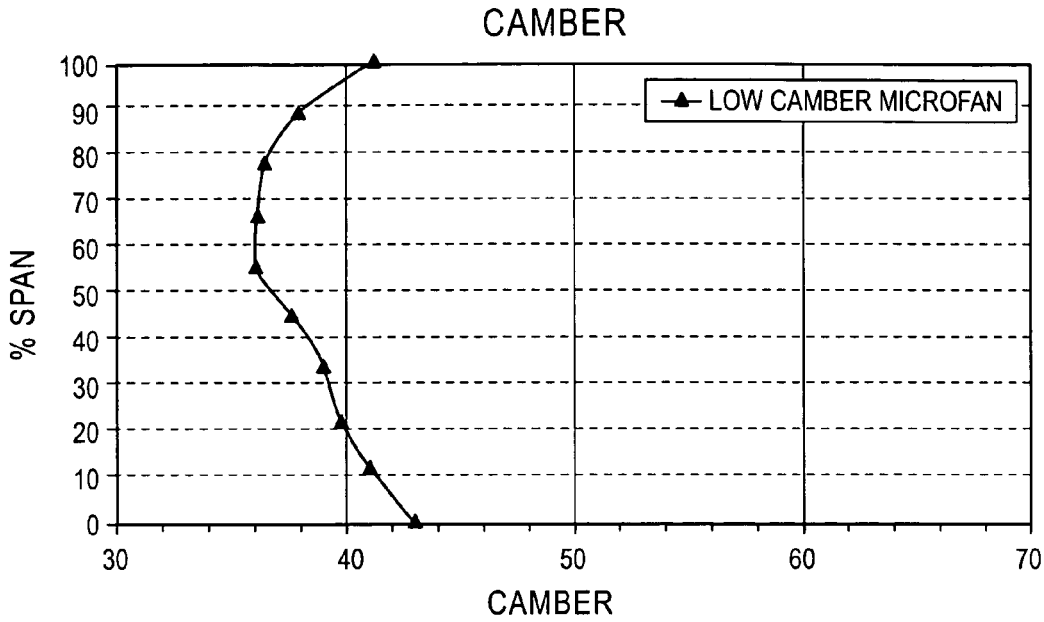
FIGS. 14A through 14D are graphs showing the values of camber, stagger, solidity and normalized chord, respectively, for an embodiment of an outlet guide vane in accordance with the present invention.
Figure 14B:
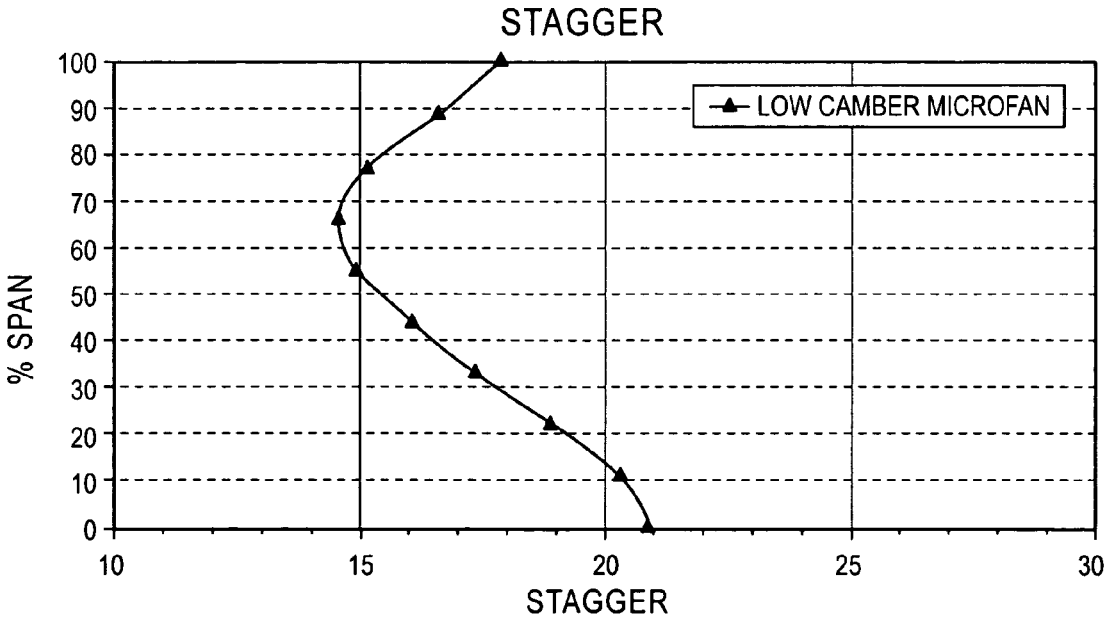
Figure 14C:
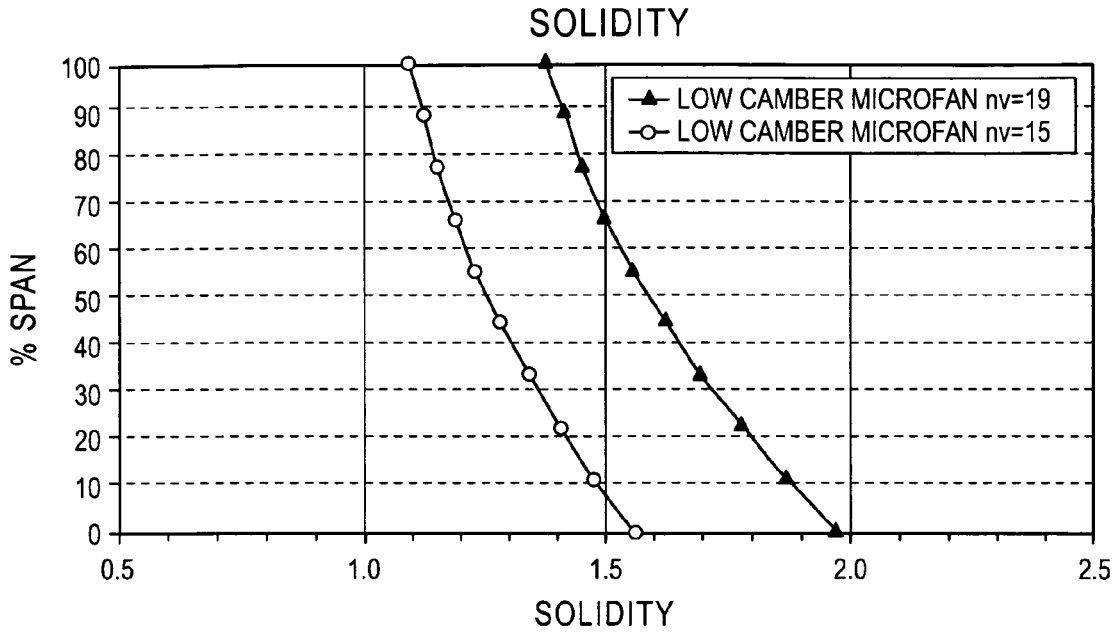
Figure 14D:
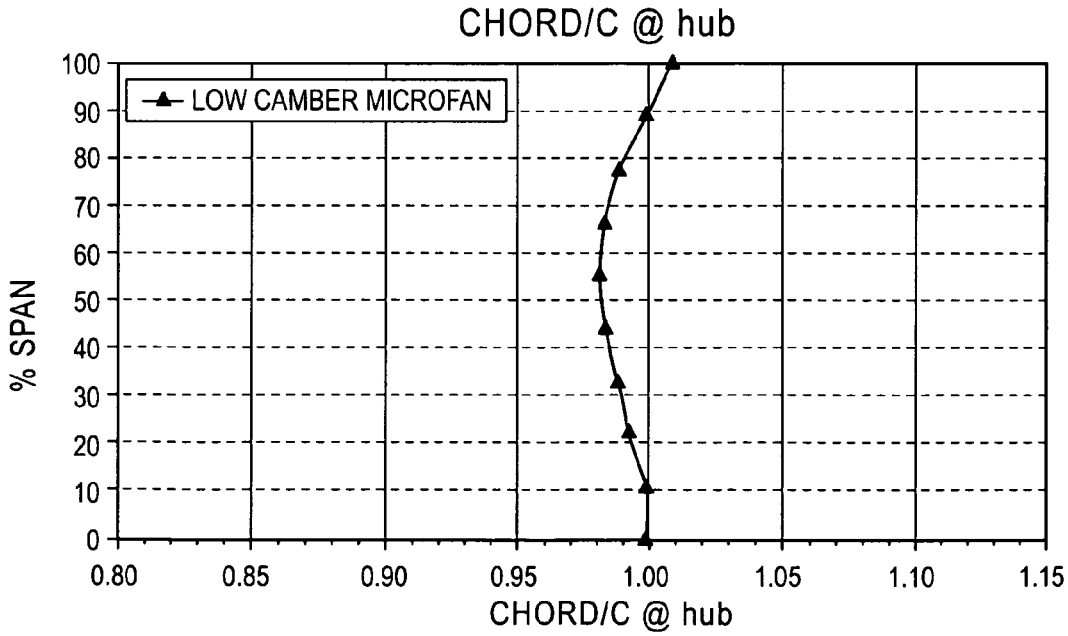

In an exemplary embodiment of the invention, each guide vane 50 comprises the values of camber, stagger, solidity and normalized chord shown in FIGS. 14A through 14D, respectively. As shown in FIG. 14A, the camber of the guide vane 50 is highest near its hub, decreases to a minimum near its midspan, and then increases again towards its tip. As discussed above, the moderate camber across the entire span in the trailing edge region of the guide vane 50 enables the outlet guide vane assembly 20 to be manufactured using an injection molding, casting or similar technique. As shown in FIG. 14B, the stagger is highest near both the hub and the tip of the guide vane 50 and is lowest at about 60 percent to 70 percent of the span. As shown in FIG. 14C, the solidity values for two different embodiments of the outlet guide vane assembly, one comprising fifteen guide vanes and the other nineteen guide vanes, exhibit similar spanwise trends. In both embodiments, solidity is maximum at the hub of the guide vane and decreases to a minimum at the tip of the guide vane. Also, as shown in FIG. 14D, the chord of the guide vanes 50 is essentially constant across the entire span. The aspect ratio of the guide vanes 50 in this embodiment is approximately 0.69.

When the two-dimensional airfoil segments 52 are stacked together to form the impeller blades 40 and the guide vanes 50, the locus of the leading edge points forms the leading edge line of the blade or vane and the locus of the trailing edge points forms the trailing edge line of the blade or vane. These leading and trailing edge lines can take a variety of forms:

they may be straight and radial, they may be straight with lean, or they may be curved, introducing bow into the blade or vane.

Bow and lean are conventionally used in impeller blades. However, the use of these features in the guide vanes 50 of the present invention is believed to be unique. Bow is incorporated into the guide vanes 50 to help balance the aerodynamic loading in the spanwise direction of the vanes. Increasing bow in this direction reduces the aerodynamic loading of the airfoil segments 52 near the endwalls (i.e., the radially inner and outer ends of the vanes) and results in increased loading of the airfoil segments near the midspan of the vanes. Bow also tends to energize the end wall boundary layers, making them less susceptible to separation.

Referring to FIG. 11, bow and lean can be illustrated using a representation of a number of guide vanes viewed from an aft-looking-forward position. In this embodiment, the trailing edge of the guide vanes is bowed, or curved, rather than straight between the hub and the tip. In addition, a straight line connecting the trailing edge hub point with the trailing edge tip point is leaned in the tangential direction relative to the radial direction. Also, the guide vanes may comprise a local lean angle at the hub or the tip, or both.

Figure 12:
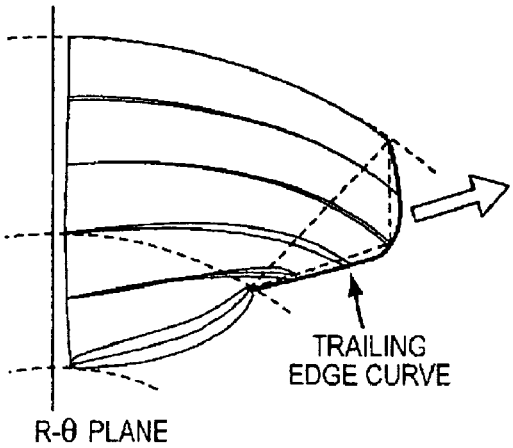
FIG. 12 (PRIOR ART)
FIG. 12 is representation of an exemplary impeller blade which illustrates several identifying features of the blade.
Figure 12A:
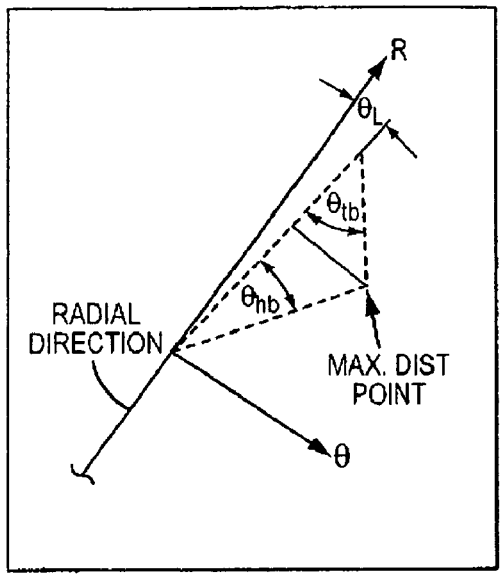
FIG. 12A (PRIOR ART)
FIG. 12A is an isolated view of the portion of the impeller blade identified by dotted lines in FIG. 12.
Figure 12B:
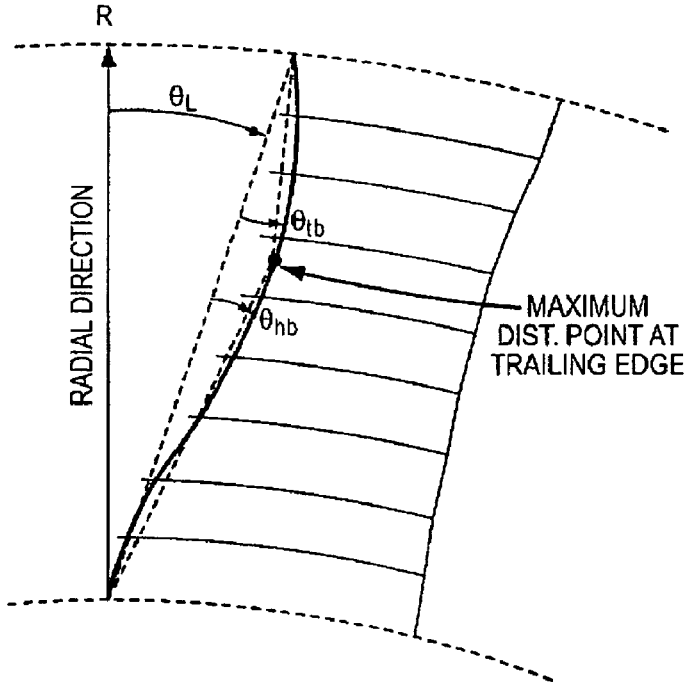
FIG. 12B (PRIOR ART)
FIG. 12B is a representation of an exemplary outlet guide vane which illustrates several identifying features of the vane.

A convenient way to describe bow and lean for a general leading or trailing edge curve is illustrated in FIG. 12. Here, a front projection (i.e., a projection in the R-θ plane) of an impeller blade is made and, in this case, the trailing edge curve is highlighted. A line is then drawn between the trailing edge hub point and the trailing edge tip point. As shown in FIG. 12A, the angle this line makes with the radial direction R is the lean angle $\theta_L$, and in this particular case the lean angle is positive. For purposes of comparison, a front projection of a guide vane is depicted in FIG. 12B, and the lean angle $\theta_L$ of the trailing edge of the guide vane is likewise positive.

To quantify bow, a triangle is drawn between the trailing edge hub point, the trailing edge tip point and a point on the trailing edge curve which is farthest from the line connecting these two points. The angles $\theta_{hb}$ and $\theta_{tb}$ of this triangle describe the degree of bow at the hub and the tip, respectively, of the blade or vane. Positive bow angles for an impeller blade trailing edge and a guide vane trailing edge are shown in FIGS. 12A and 12B, respectively. Referring to FIG. 12B, in this embodiment the guide vane trailing edge lean and bow angles are such that the vane suction surface makes an obtuse angle with the adjacent flowpath wall at both the hub and the tip.

Representative values of lean and bow for the impeller blades 42 and the guide vanes 50 of one embodiment of the present invention are given in Table 3.

TABLE 3

Representative Lean and Bow Values

| | Lean angle ($\theta_L$) (degrees) | Bow angle @ hub ($\theta_{hb}$) (degrees) | Bow angle @ tip ($\theta_{tb}$) (degrees) |
|---|---|---|---|
| Impeller Blade Leading Edge | −13-−8 | −2-+3 | 0-5 |
| Impeller Blade Trailing Edge | 12-17 | 11-16 | 21-26 |
| Guide Vane Leading Edge | −1-+4 | 1-6 | 3-8 |
| Guide Vane Trailing Edge | 15-25 | 0-10 | 5-15 |

It should be recognized that, while the present invention has been described in relation to the preferred embodiments thereof, those skilled in the art may develop a wide variation of structural and operational details without departing from the principles of the invention. For example, the various elements shown in the different embodiments may be combined in a manner not illustrated above. Therefore, the appended claims are to be construed to cover all equivalents falling within the true scope and spirit of the invention.

We claim:

1. A cooling fan which comprises:

an impeller which includes a plurality of radially extending blades, each of which includes a blade hub, a blade tip and a blade midspan approximately midway between the hub and the tip;

wherein each blade comprises a blade suction surface;

wherein substantially the entire blade suction surface is visible from the forward looking aft direction; and wherein each blade comprises a camber of between about 52° and 62° at the blade hub, between about 45° and 56° at the blade midspan and between about 28° and 38° at the blade tip.

2. The cooling fan of claim 1, wherein no two adjacent blades overlap when viewed in the forward looking aft direction.

3. The cooling fan of claim 1, wherein the impeller comprises eight blades and wherein the tangential distance between each blade and an adjacent blade is at least about 0.05 inch.

4. The cooling fan of claim 1, wherein each blade comprises a camber of between about 54° and 59° at the blade hub, between about 49° and 54° at the blade midspan and between about 31° and 36° at the blade tip.

5. The cooling fan of claim 1, wherein each blade comprises a stagger of between about 19° and 29° at the blade hub, between about 36° and 46° at the blade midspan and between about 47° and 57° at the blade tip.

6. The cooling fan of claim 5, wherein each blade comprises a stagger of between about 22° and 27° at the blade hub, between about 39° and 44° at the blade midspan and between about 50° and 55° at the blade tip.

7. The cooling fan of claim 1, wherein each blade comprises a solidity of between about 1.6 and 2.0 at the blade hub, between about 1.15 and 1.55 at the blade midspan and between about 0.85 and 1.25 at the blade tip.

8. The cooling fan of claim 7, wherein each blade comprises a solidity of between about 1.7 and 1.95 at the blade hub, between about 1.25 and 1.45 at the blade midspan and between about 0.95 and 1.15 at the blade tip.

9. The cooling fan of claim 1, wherein each blade comprises a normalized chord of about 1.0 at the blade hub, between about 0.95 and 1.1 at the blade midspan and between about 0.85 and 1.25 at the blade tip.

10. The cooling fan of claim 9, wherein each blade comprises a normalized chord of about 1.0 at the blade hub, between about 0.95 and 1.00 at the blade midspan and between about 0.95 and 1.05 at the blade tip.

11. The cooling fan of claim 1, wherein each blade includes a leading edge which comprises a lean angle of between about −13° and −8°, a bow angle at the blade hub of between about −2° and 3° and a bow angle at the blade tip of between about 0° and 5°.

12. The cooling fan of claim 11, wherein each blade includes a trailing edge which comprises a lean angle of between about 12° and 17°, a bow angle at the blade hub of between about 11° and 16° and a bow angle at the blade tip of between about 21° and 26°.

13. The cooling fan of claim 1, further comprising:

an outlet guide vane assembly which includes a plurality of radially extending guide vanes, each of which comprises a vane hub, a vane tip and a vane midspan approximately midway between the vane hub and the vane tip;

wherein each blade comprises a vane suction surface; and wherein substantially the entire vane suction surface is visible from the forward looking aft direction.

14. The cooling fan of claim 13, wherein each guide vane comprises a camber of between about 38° and 48° at the vane hub, between about 32° and 42° at the vane midspan and between about 36° and 46° at the vane tip.

15. The cooling fan of claim 13, wherein each guide vane comprises a stagger of between about 16° and 26° at the vane hub, between about 11° and 21° at the vane midspan and between about 13° and 23° at the vane tip.

16. The cooling fan of claim 13, wherein each guide vane comprises a solidity of between about 1.2 and 2.2 at the vane hub, between about 1.0 and 2.0 at the vane midspan and between about 0.8 and 1.8 at the vane tip.

17. The cooling fan of claim 13, wherein each guide vane comprises a normalized chord of about 1.0 at the vane hub, between about 0.95 and 1.05 at the vane midspan and between about 0.95 and 1.05 at the blade tip.

18. A cooling fan which comprises:

an outlet guide vane assembly which includes a plurality of radially extending guide vanes, each of which comprises a vane hub, a vane tip and a vane midspan approximately midway between the vane hub and the vane tip;

wherein each blade comprises a vane suction surface;

wherein substantially the entire vane suction surface is visible from the forward looking aft direction; and wherein each guide vane comprises a camber of between about 38° and 48° at the vane hub, between about 32° and 42° at the vane midspan and between about 36° and 46° at the vane tip.

19. The cooling fan of claim 18, wherein each guide vane comprises a camber of between about 40° and 45° at the vane hub, between about 35° and 40° at the vane midspan and between about 38° and 43° at the vane tip.

20. The cooling fan of claim 18, wherein each guide vane comprises a stagger of between about 16° and 26° at the vane hub, between about 11° and 21° at the vane midspan and between about 13° and 23° at the vane tip.

21. The cooling fan of claim 20, wherein each guide vane comprises a stagger of between about 18° and 23° at the vane hub, between about 13° and 18° at the vane midspan and between about 15° and 20° at the vane tip.

22. The cooling fan of claim 18, wherein each guide vane comprises a solidity of between about 1.2 and 2.2 at the vane hub, between about 1.0 and 2.0 at the vane midspan and between about 0.8 and 1.8 at the vane tip.

23. The cooling fan of claim 22, wherein each guide vane comprises a solidity of between about 1.5 and 2.0 at the vane hub, between about, 1.2 and 1.6 at the vane midspan and between about 1.0 and 1.4 at the vane tip.

24. The cooling fan of claim 18, wherein each guide vane comprises a normalized chord of about 1.0 at the vane hub, between about 0.95 and 1.05 at the vane midspan and between about 0.95 and 1.05 at the blade tip.

25. The cooling fan of claim 24, wherein each guide vane comprises a chord of about 1.0 at the vane hub, between about 0.96 and 1.01 at the vane midspan and between about 0.98 and 1.03 at the blade tip.

26. The cooling fan of claim 18, wherein each guide vane includes a leading edge which comprises a lean angle of between about −1° and 4°, a bow angle at the vane hub of between about 1° and 6° and a bow angle at the vane tip of between about 3° and 8°.

27. The cooling fan of claim 26, wherein each guide vane includes a trailing edge which comprises a lean angle of between about 15° and 25°, a bow angle at the vane hub of between about 0° and 10° and a bow angle at the vane tip of between about 5° and 15°.

28. The cooling fan of claim 18, further comprising:

an impeller which includes a plurality of radially extending blades, each of which includes a blade hub, a blade tip and a blade midspan approximately midway between the hub and the tip;

wherein each blade comprises a blade suction surface; and wherein substantially the entire blade suction surface is visible from the forward, looking aft direction.

29. The cooling fan of claim 28, wherein no two adjacent blades overlap when viewed in the forward looking aft direction.

30. The cooling fan of claim 28, wherein each blade comprises a camber of between about 52° and 62° at the blade hub, between about 45° and 56° at the blade midspan and between about 28° and 38° at the blade tip.

31. The cooling fan of claim 28, wherein each blade comprises a stagger of between about 19° and 29° at the blade hub, between about 36° and 46° at the blade midspan and between about 47° and 57° at the blade tip.

32. The cooling fan of claim 28, wherein each blade comprises a solidity of between about 1.6 and 2.0 at the blade hub, between about 1.15 and 1.55 at the blade midspan and between about 0.85 and 1.25 at the blade tip.

33. The cooling fan of claim 28, wherein each blade comprises a normalized chord of about 1.0 at the blade hub, between about 0.95 and 1.1 at the blade midspan and between about 0.85 and 1.25 at the blade tip.

* * * * *